US006244598B1

(12) United States Patent
Conville

(10) Patent No.: US 6,244,598 B1
(45) Date of Patent: Jun. 12, 2001

(54) FOLDING CORRUGATED BAG TOSSING GAME

(75) Inventor: David J. Conville, Hot Springs, AR (US)

(73) Assignee: Conlab, Inc., Hot Springs, AR (US)

( * ) Notice: Subject to any disclaimer, the term of this patent is extended or adjusted under 35 U.S.C. 154(b) by 0 days.

(21) Appl. No.: 09/351,455

(22) Filed: Jul. 12, 1999

(51) Int. Cl.[7] ..... A63B 63/00
(52) U.S. Cl. ..... 273/402
(58) Field of Search ..... 273/398–402; 473/180, 185

(56) References Cited

U.S. PATENT DOCUMENTS

| | | | | |
|---|---|---|---|---|
| D. 252,047 | | 6/1979 | Cirrone | D21/24 |
| D. 363,953 | | 11/1995 | Buse | D21/5 |
| 1,636,920 | | 7/1927 | Nichols | 273/402 |
| 1,683,875 | * | 9/1928 | Duffy et al. | 473/180 |
| 1,773,813 | * | 8/1930 | Gourlay et al. | 473/185 |
| 1,996,986 | * | 4/1935 | Weinberg | 273/400 |
| 2,021,989 | | 11/1935 | De Masater | 273/401 |
| 2,050,914 | | 8/1936 | Anderson | 273/401 |
| 2,291,104 | | 7/1942 | Radzyner | 273/441 |
| 3,480,280 | | 11/1969 | Gamertsfelder | 273/106 |
| 3,554,550 | | 1/1971 | Schram | 273/95 |
| 3,628,793 | | 12/1971 | Mudloff | 273/402 |
| 3,837,650 | | 9/1974 | Haney | 273/402 |
| 3,837,653 | | 9/1974 | Fox et al. | 273/178 R |
| 4,022,472 | * | 5/1977 | Seals | 273/400 |
| 4,116,443 | | 9/1978 | Dorfman | 273/95 R |
| 4,186,925 | | 2/1980 | Goldfarb et al. | 273/389 |
| 4,243,229 | | 1/1981 | Huser et al. | 273/402 |
| 4,565,375 | | 1/1986 | Dresel | 273/401 |
| 4,709,929 | | 12/1987 | Mills et al. | 273/402 |
| 4,726,591 | * | 2/1988 | Johnson | 273/402 |
| 4,923,201 | | 5/1990 | Nichol et al. | 273/371 |
| 4,927,160 | | 5/1990 | Nichol et al. | 273/371 |
| 4,927,161 | * | 5/1990 | Brenneman | 273/402 |
| 4,938,485 | | 7/1990 | Hockridge et al. | 273/401 |
| 4,943,065 | | 7/1990 | DeLapa | 273/402 |
| 4,961,586 | | 10/1990 | Conville | 273/402 |
| 5,056,796 | | 10/1991 | Conville | 273/402 |
| 5,087,046 | * | 2/1992 | Mauch | 473/180 |
| 5,165,695 | | 11/1992 | Yoder | 273/402 |
| 5,318,308 | | 6/1994 | Holms | 273/346 |
| 5,332,230 | | 7/1994 | Benedict | 273/346 |
| 5,765,832 | * | 6/1998 | Huff | 273/402 |
| 5,871,216 | | 2/1999 | Sparacino | 273/402 |

* cited by examiner

*Primary Examiner*—Mark S. Graham
(74) *Attorney, Agent, or Firm*—Stephen D. Carver

(57) ABSTRACT

A bag tossing game for use by one or more players comprises a pair of spaced-apart, wedge-shaped target assemblies that are erected by suitably unfolding a unitary corrugated blank. Each target assembly presents an outer, inclined, surface comprising a target orifice. The blank has a central panel forming the outer surface, a pair of foldable sides forming a fluteless bottom, and a front and a rear each having two foldable panels that present a fluteless bottom To minimize wear, each target orifice is snap-fitted with a plastic reinforcement ring that also seals out moisture. Stabilizer ribs formed from corrugated blanks extend transversely beneath the target assemblies between the folded sides to reinforce the target assemblies and reduce bouncing. The rib blank comprises two main panels folded across a fold line to form a fluteless bottom and a V-configuration. Integral subpanels overlie one another to a triangular base. Consequently, no open flutes or exposed edges of the target assemblies contact the ground and allow the entrance of moisture. During play a pair of target assemblies can be connected by a distance regulator to maintain stability and preserve compliance with the rules.

22 Claims, 9 Drawing Sheets

FOLDING CORRUGATED BAG TOSSING GAME

BACKGROUND OF THE INVENTION

1. Field of the Invention

This invention relates generally to tossing games wherein one or more players toss bags at apertured, inclined targets. More particularly, this invention relates to tossing games comprising corrugated boards that can be foldably transformed between flat, shipping or storage modes and fully-deployed, playing modes. The closest prior art game patents known to me are found in Class 273, Subclasses 398, and 400, 401, and 402.

2. Description of the Prior Art

A number of prior art tossing games involving projectiles thrown at inclined targets exist. Relevant prior art tossing games comprise target structures with inclined and apertured front surfaces towards which projectiles, including bean bags, may be thrown.

Prior U.S. Pat. No. 5,056,796 owned by the same assignee as in this case discloses a tossing game for use by one or more players. The plastic, blow-molded target pieces can be quickly transformed between a convenient transportable mode and a playing mode. In the transport mode they are coupled together, forming a parallelepiped. In the playing mode they are detached, separated, and then deployed by the players in spaced-apart relation. Each of the wedge-shaped, modular targets comprises an inclined, apertured surface towards which beanbags are thrown to generate points in accordance with rules. During deployment, each target board is inclined by unfolding elevator trays that are pivotally coupled to the target underside. The beanbags are stored within interior compartments.

Prior U.S. Pat. No. 4,961,586, also owned by the same assignee as in this case, discloses a similar tossing game. A pair of molded plastic targets can be coupled together for storage and transportation. In the playing mode, the modular, wedge-shaped targets are separated from one another. Each of the wedge-shaped, and inclined targets presents an apertured playing board towards which bean bags are thrown. Each target comprises a separate, removable, elevator tray that is snap fitted to the boards to incline them for play. The trays also prevent bags dropping through the target hole from escaping the board underside. A brace extending from the board underside reinforces the trays during play.

Earlier versions of inclined target games comprising apertured, inclined planes abound. U.S. Pat. No. 2,021,989 discloses an inclined, wooden surface having an aperture functioning as a target. Balls tossed by a player towards the target may be collected within a pocket if they penetrate the target orifice.

U.S. Pat. No. 3,628,793, issued Dec. 21, 1971, and entitled Sandbag and Target Apparatus, discloses a pair of fixed. wedge-shaped half sections, each including an apertured and inclined plane functioning as a target. Bags are tossed toward each target, and separate rules determine point scoring by the players. Points are awarded when bags penetrate the target, or when they remain on the target surface after a round. The individual wedge-shaped sections may be deployed separately in a tossing game configuration, or they may be clamped together in the form of a parallelepiped for storage or transportation. The target sections are relatively cumbersome and heavy, making convenient transportation and deployment difficult.

U.S. Pat. No. 4,709,929 issued Dec. 1, 1987 discloses a pair of apertured game boards that function as targets. They can be separated for play or coupled together for transportation or storage.

U.S. Pat. No. 3,837,650 discloses a bag vice having a pair of hinged panels that can be deployed in an inclined target mode. As before, the target surface has a hole towards which bags are thrown. Similar devices are seen in U.S. Pat. No. 2,291,104, issued Jul. 28, 1942, U.S. Pat. No. 4,243,229 issued Jan. 6, 1981, and U.S. Pat, No. 4,565,375, issued Jan. 21, 1986. All of the latter patents disclose toss games comprising a target orifice.

U.S. Pat. No. 3,480,280, issued Nov. 25, 1969 discloses a bean bag design for a projectile suitable for in bag tossing games.

U.S. Pat. No. 3,837,650 issued Sep. 24, 1974, comprises a foldable, reinforced wooden tossing game, in which U.S. Pat. No. 3,837,653 issued Sep. 24, 1974, comprises a game in which a slightly inclined plane forms a target for a golf ball.

Other tossing games involving inclined target surfaces are disclosed in U.S. Pat. Nos. 3,554,550; 4,186,925; 4,116,443; 4,943,065, 5,165,695 and U.S. Pat. Des. No. 252,047.

Despite the fact that tossing games constructed as described above are fun to play, no known bag-tossing game has been particularly successful on the market. Older wooden games are simply too heavy. Their weight and bulk makes shipping and inventory costs prohibitive for modern retailers. Wooden games are expensive and time consuming to produce. Even modern, lightweight, plastic designs with modular components can be relatively expensive. Despite the fact that modern, streamlined plastic designs employ low-profile targets that are easily stored or transported, they have too much weight and bulk. When deployed for storage, they are generally cubicle rather than flat. As a result, packaging and shipping costs are prohibitive, as shipping volume cannot be minimized. Even though robust plastic designs that are reinforced with only minimal components are relatively lightweight, their weight and bulk are significant, when compared to paper and cardboard games. On the other hand, it has hitherto been the case that paper and cardboard designs do not function well as impact-absorbing devices. Their use as targets for bean bag tossing games of the type discussed above has thus been suspect. Unless properly designed, cardboard or corrugated tossing targets are easily worn out. For one thing, acceptable reinforcement structures have not been integrated into an acceptable folding design. Secondly, edge portions of typical folding devices have open flutes that are exposed to the ground and moisture; as a result, wetness is drawn into the unit, degrading its strength and inviting rotting.

SUMMARY OF THE INVENTION

My new bag-tossing game is formed from lightweight, corrugated material. It can be quickly folded between a flat, very low profile shipping or storage orientation, and a fully-deployed game position. When unfolded for storage, game target units are less that one half inch thick, so multiple units can be stacked together for efficient, bulk shipping. Thus attainable storage volume is extremely low. Despite the fact that the volume and weight of the target assemblies are significantly reduced, strength and unit integrity are preserved. Through the use of critical reinforcement folds as disclosed hereinafter, the erected target assemblies are relatively vigorous, and they withstand repeated impacts from multiple plays.

The preferred game comprises a pair of spaced-apart, generally wedge-shaped target assemblies. Each has an inclined surface with a round target aperture. Preferably each target assembly is assembled by appropriately folding a flat, corrugated blank. The preferred blank is configured with numerous fold lines that generally separate what will become three-dimensional structural portions of the target assembly. The blank is clearly labeled with numbered assembly instructions. When the blank portions are folded together, the composite unit that results forms a wedge-shaped, game-toss target that is profiled similarly to the prior art plastic and wooden designs discussed above.

Resiliency is insured in part by the corrugated ribbing that prevents impact-related bouncing. The reinforcement ribs are made from separate blanks that fold together in a user-friendly fashion. They are fitted beneath the target assembly, mating with coupling structure defined in the target blank. They touch the ground at their folded bottoms to give added structural support.

The corrugated material is treated with water-repellent material, and no open flutes touch the ground when the target assembly is created. A ring-shaped plastic insert reinforces the target orifice to minimize wear and water damage. With the aforesaid structure moisture is not wicked into the structure, so water-related deterioration is avoided.

In the playing mode, the target assemblies are spaced apart a predetermined distance established by the rules. By connecting the targets together with a fixed length distance regulator, compliance with the rules is insured and target stability is enhanced. A number of harmless bean bags, preferably filled with corn, are thrown at the target assemblies by the players. The bags can be stored within the target assemblies when the game is not being used.

Thus a general object of the invention is to provide a low-cost bag tossing game whose target assemblies can be erected from totally flat pieces.

A related object is to provide a bag tossing game of the character described that is extremely lightweight, and durable.

Another object of the invention is to provide a resilient and long-lasting bag tossing game made from a simple and inexpensive flat blank.

Similarly, it is an object to provide a bag tossing game of the character described which is characterized by an extremely low shipping volume. It is a feature of the invention that the volume of the playing targets can be reduced approximately eighty-two percent by unfolding the target assemblies and deploying the corrugated blank in a flat shipping orientation.

Another object is to provide a corrugated blank that may be easily folded into an apertured, wedge-shaped, tossing game target.

Still another object is to provide a corrugated, bag tossing game of the character described that is suitable for use by adults and children.

A fundamental object is to provide a bag tossing game that is easy for the manufacturer to ship, and convenient for the retailer to inventory.

A related object is to provide a bag tossing game that is easy to erect and deploy.

Another object is to provide lightweight, corrugated target assemblies that may be quickly and easily folded between storage and playing orientations.

A related object is to provide lightweight, corrugated reinforcement ribs that may be quickly and easily folded together prior to insertion within the target Another object is to provide a corrugated game of the character described a feature of the invention that appropriate advertising logos, slogans or the like can be easily printed on the target assembly blank.

Another object is to provide a safe tossing game that uses harmless bags filled with nontoxic materials.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
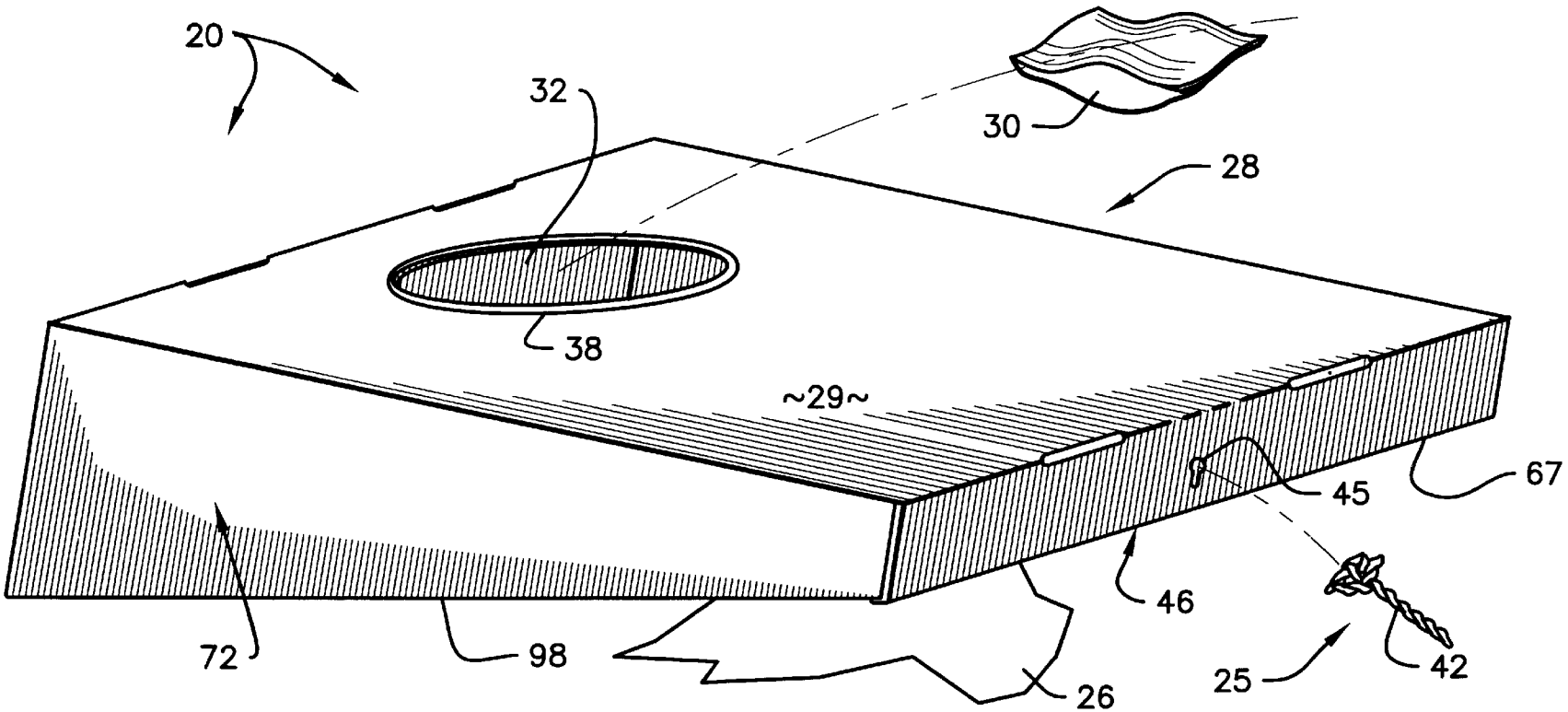
FIG. 1 is a partially exploded isometric view of a game tossing target constructed in accordance with the teachings of this invention, illustrating a bag projectile in flight towards the target.
Figure 2:
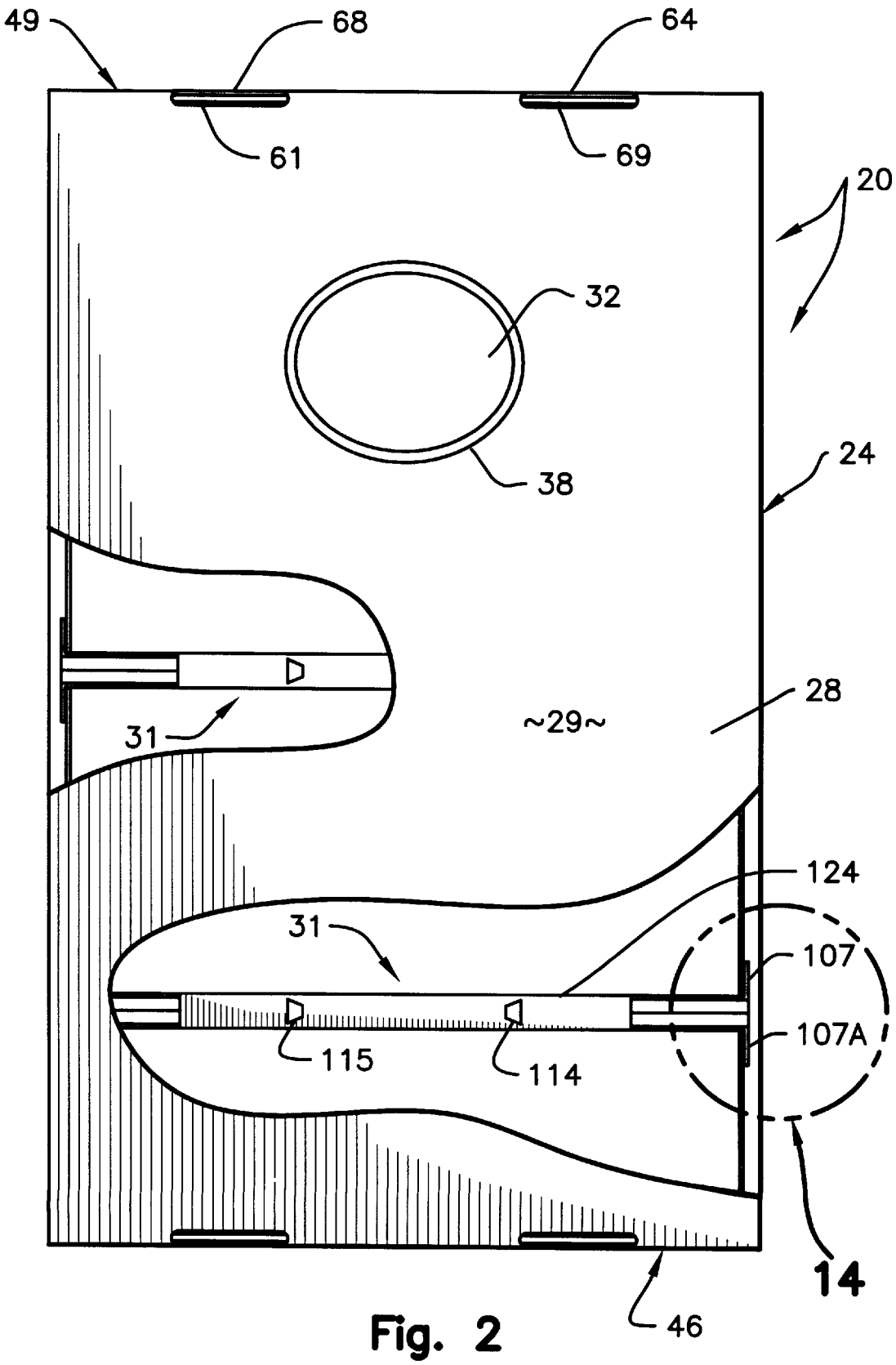
FIG. 2 is a fragmentary, top plan view of the game target of FIG. 1, with portions thereof broken away or shown in section for clarity.

With initial reference directed to FIGS. 1–5 of the appended drawings, a portable bag tossing game constructed in accordance with the best mode of the invention has been generally designated by the reference numeral 20. It will be appreciated that, when properly deployed, game 20 comprises a pair of fully-erected and spaced-apart target assemblies 24, each of which is preferably placed upon a flat supporting surface 26 (FIG. 1). It is preferred that the twin target assemblies required during play are properly spaced apart by a distance regulator 25 (FIG. 1) that extends between and is fastened to front portions of both target assemblies. Each generally wedge-shaped target assembly 24 comprises an inclined central panel 28 with an external playing surface 29A oriented towards a player standing a distance away from the assembly. During play, suitable projectiles 30 (i.e., preferably comprising soft bags filled with beans or popcorn) are tossed by players towards opposing target assemblies. Maximum points are awarded when bean bags penetrate the target orifice 32. Points are also earned when, after a player's turn, bags thrown by the player remain on the outer, exposed impact surface 29A (FIG. 1) of panel 28.

Figure 4:
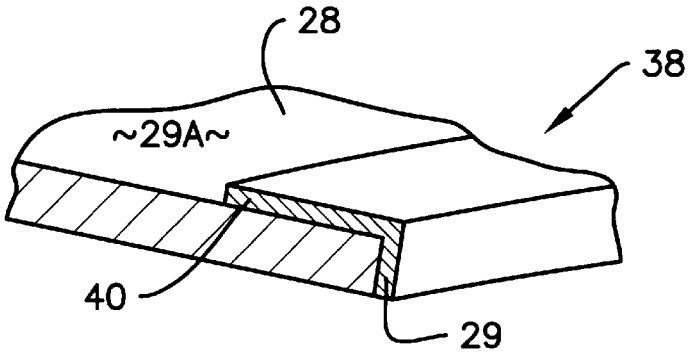
FIG. 4 is an enlarged, fragmentary, sectional view taken generally along line 4—4 of FIG. 3, showing the preferred reinforcement ring.

Each wedge-shaped target assembly 24 is deployed by suitably folding together a unitary, corrugated blank 34 (FIG. 11) as explained hereinafter. Each target assembly is preferably braced by a pair of reinforcement ribs that extend transversely beneath panel 28 between opposing sides of the target assembly. The ribs contact the ground or supporting surface and provide structural support. Each rib is preferably formed from a unitary, corrugated blank 36 (FIG. 12) that must be folded as explained hereinafter. In the best mode each target assembly further comprises a resilient reinforcement ring 38 that is coaxially snap fitted within target orifice 32 to protect the orifice periphery from wear. As seen in FIG. 4, the preferred ring 38 is of generally L-shaped cross section, with a vertical lip 39 circumferentially pressed against the periphery of orifice 32, and an integral flange portion 40 laying atop impact surface 29A (FIG. 4). Lip 39 contacts the flute edges of the panel that would otherwise be exposed, and helps seal out moisture.

After the ring and stiffener ribs are attached, it is preferred that the spaced-apart wedge assemblies are coupled together with the distance regulator 25. The regulator comprises an elongated string 42 extending between terminal fittings 44 that are received within slotted, key-shaped orifices 45 defined in the front 46 of each target assembly. As a practical matter, the "fittings" 44 may be formed from knots tied into the string at appropriate intervals. The preferred T-shaped cross section of each regulator string fitting 44 insures captivation within the slot of orifice 45 so that tension on string 42 maintains proper game spacing.

Figure 11:
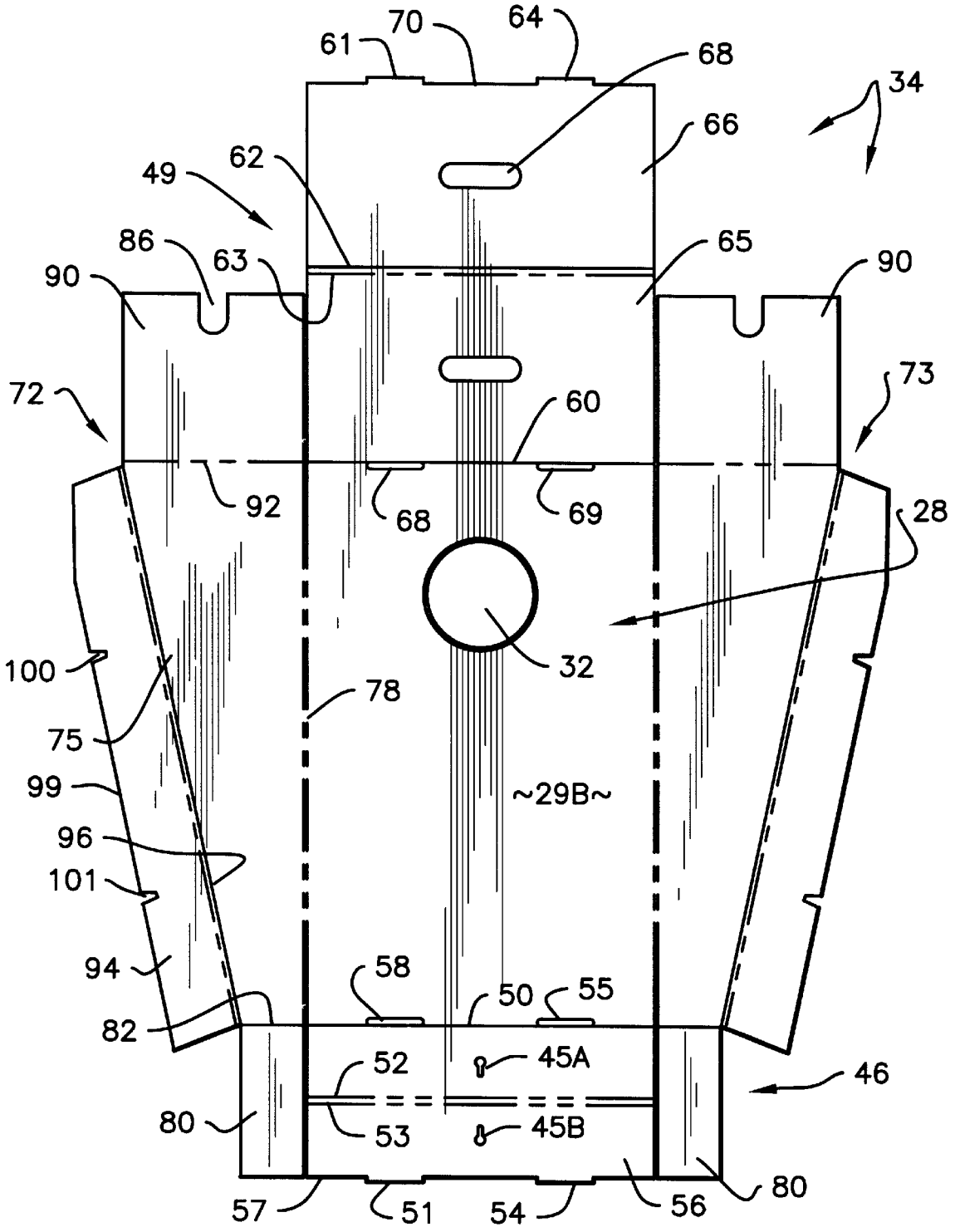
FIG. 11 is a plan view of the underside of the preferred corrugated blank that is suitably folded to form a target assembly.

With additional reference directed now to FIG. 11, the target assembly is erected by suitably folding a corrugated blank 34. In other words, each major portion of the three dimensional "wedge" seen in FIG. 1 results as a consequence of completely, properly folding the generally planar corrugated panel portions to be described about the illustrated fold lines. When so assembled, the resulting target assembly is resilient and impact resistant, and no open flutes (i.e., at exposed outermost edges of the corrugated blank) are exposed to moisture (i.e., lying upon surface 26) to weaken the assembly. It is also important that the reinforcement ribs are folded together from another flat, unitary, corrugated blank 36 (FIG. 12) such that no open flutes are exposed to absorb moisture. Moreover it is highly advantageous that the ribs are captivated between opposite wedge panels when assembled, through coupling structure integrally formed in the panels.

Figure 3:
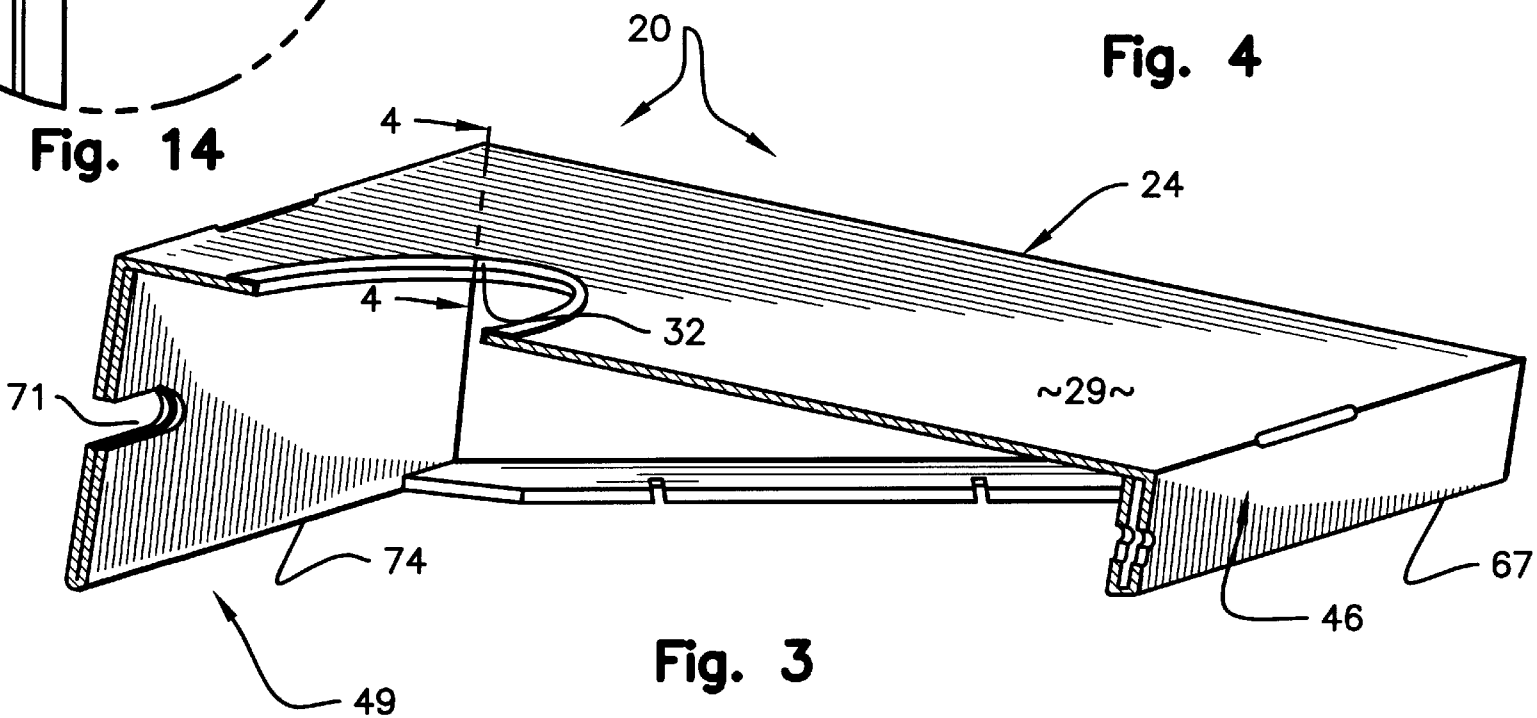
FIG. 3 is a fragmentary, isometric view of a preferred target with the reinforcement ribs removed, and with portions thereof broken away or shown in section for clarity.
Figure 5:
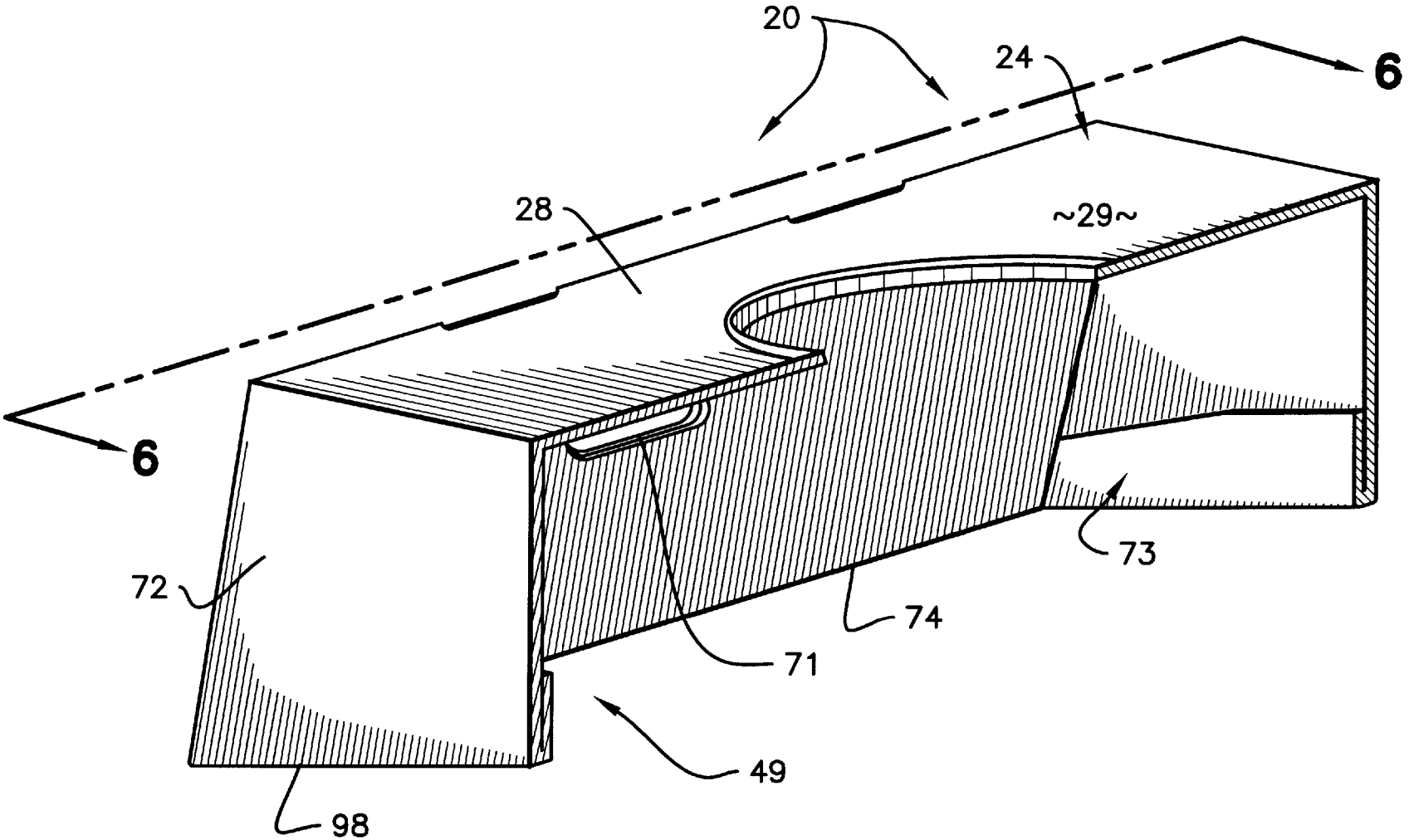
FIG. 5 is a fragmentary, isometric view of an assembled target assembly, with portions thereof broken away or shown in section for clarity.
Figure 6:
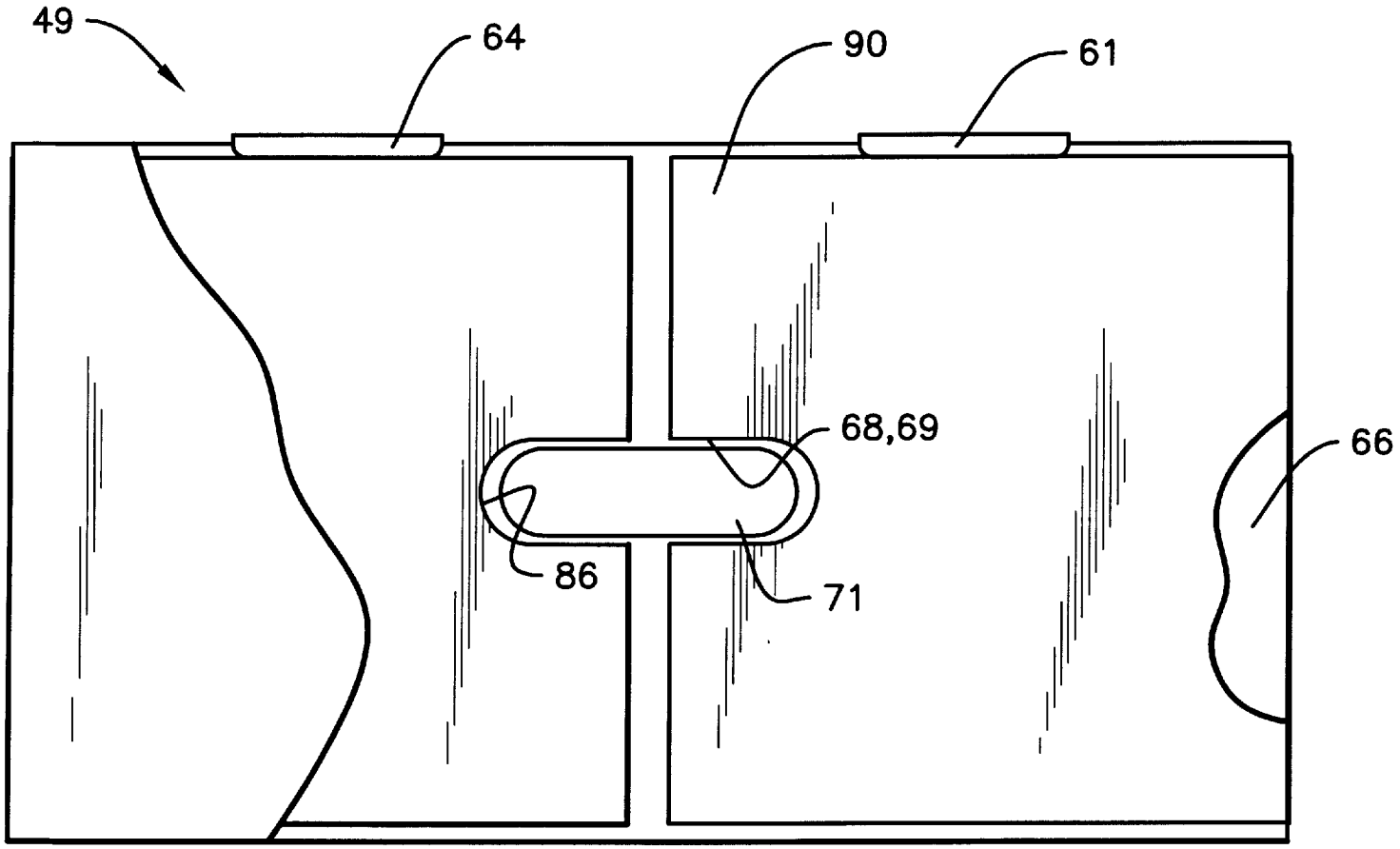
FIG. 6 is an enlarged, rear plan view of the target assembly taken generally along line 6—6 of FIG. 5.

The underside 29B of the target assembly panel 28 is exposed to the viewer in FIG. 11. The central panel 28 has an underside 29B coextensive with outer impact surface 29A (FIG. 1). Panel 28 is integral with a dual-panel front 46 and a similar dual-panel or two-part rear 49 (FIGS. 3, 5, 6). A unitary fold line 50 forms a boundary between front 46 and central panel 28. Front 46 comprises a pair of similarly-dimensioned rectangular panels 55, 56 foldably separated from one another by a pair of closely spaced apart fold lines 52, 53. A pair of spaced-apart rectangular locking tabs 51, 54 emanating from the lower (i.e., as viewed in FIG. 11) panel 56 are designed to mate within matching slots 58, 59 when the front 46 is folded together about lines 52, 53.

The width of material disposed between fold lines 52, 53 (FIG. 11) broadens the surface area of the resultant bottom edge 67 (FIGS. 1, 3) that contacts surface 26 (FIG. 1) when the target is assembled. Thus bottom 67 of the target front 46 is "fluteless," in that there are no exposed flutes open to the environment for contamination. Further, it will be noted that the exposed flutes in edge 57 of panel 56 (i.e., disposed as in FIG. 11 prior to assembly) are folded up away from the ground, in fact bordering undersurface 29B adjacent the slots 58, 59. Finally, the matching key hole orifices 45A and 45B respectively defined in front panels 55, 56 align after folding to present the unitary orifice 45 (FIG. 1) that anchors the distance regulator 25 described earlier.

The two-part rear 49 is larger than the front 46 so that an incline results after assembly. Unitary fold line 60 (FIG. 11) forms a boundary between rear 49 and panel 28. The rear 49 comprises a pair of similar rectangular panels 65, 66 foldably separated from one another by another pair of closely spaced-apart fold lines 62, 63. A pair of rectangular locking tabs 61, 64 emanating from the upper panel 66 mate within matching rectangular slots 68, 69 when the rear panel structure is folded about lines 62, 63. The width of material disposed between fold lines 62, 63 broadens the surface area of the assembled rear's bottom 74 (FIGS. 3, 5) that will contact surface 26 (FIG. 1) when the target is deployed. Importantly, bottom 74 is fluteless, and will not suck in moisture. Again, it is important that exposed flutes in edge 70 of panel 56 (i.e., disposed as in FIG. 11 prior to assembly) are folded up away from the ground towards panel undersurface 29B adjacent the slots 68, 69. The similarly shaped elliptical slots 68, 69 (FIG. 11) formed in panels 66, 65 align during folding to form a rear "handle" 71 (FIGS. 3, 5, and 6).

Each target assembly comprises a pair of similar sides 72, 73 (FIG. 11) that are integral with panel 28. Since they are mirror images of one another, only one will be described in detail. Side 72 comprises a central, trapezoidal panel 75 that is integral with panel 28. An elongated vertical (i.e., as viewed in FIG. 11) fold line 78 runs between panels 28 and 75. Panel 75 is separated from an integral, generally rectangular end flap 80 by a fold line 82. When blank 34 is formed, flap 80 is completely cut free from front 46 (i.e., a cut divides panels 55, 56 from flap 80). Panel 75 is also separated from an integral, rear flap 90 by a fold line 92. Again, when blank 34 is cut, end flap 90 is separated from the adjoining panel structure comprising rear 49.

When target assembly is folded together, U-shaped channel 86 aligns with handle slots 68, 69. Further, flap 90 is captivated between panels 65 and 66. When locking tabs 61 and 64 respectively seat within slots 68. 69 (FIG. 11) it is apparent that the side maintained in proper alignment when flap 90 is thus locked. Similarly, at the other end of the apparatus, flaps 80 are locked between panels 55 and 56 when locking tabs 51, 54 are seated within slots 58, 59.

Side 72 also comprises a narrower, rectangular side flap 94 that borders integral panel 75 adjacent a twin fold line 96 similar to fold lines 52, 53 discussed earlier. The fluteless bottom 98 (FIG. 5) of the deployed side 72 contacts the ground 26 (FIG. 1). No edge flutes are exposed to moisture as the side panel edge 99 (FIG. 11) is folded up away from surface 26 about fold lines 99 during erection A pair of spaced-apart, edge notches 100, 101 are defined in flap 94.

Figure 8:
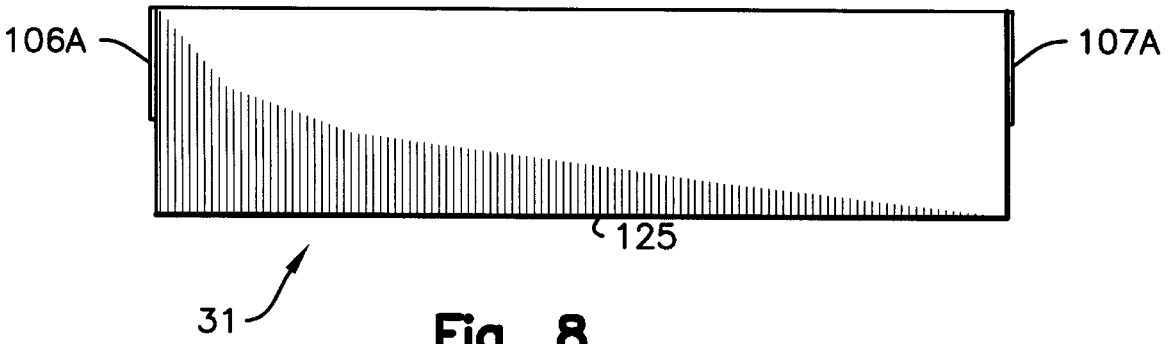
FIG. 8 is an enlarged, side elevational view of an assembled rib.
Figure 9:
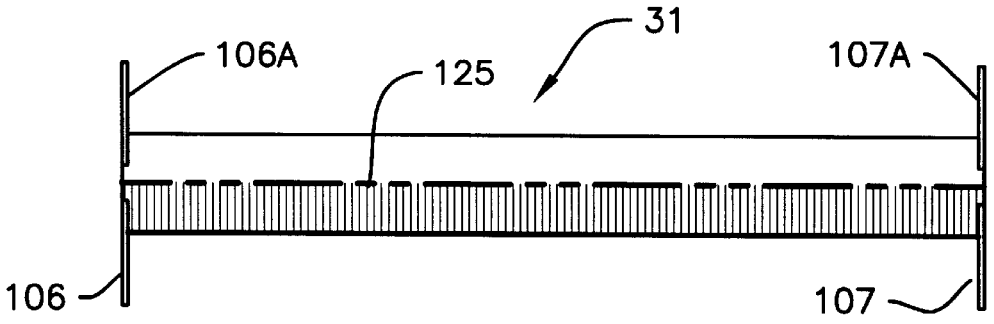
FIG. 9 is a bottom plan view of the rib of FIG. 8.
Figure 10:
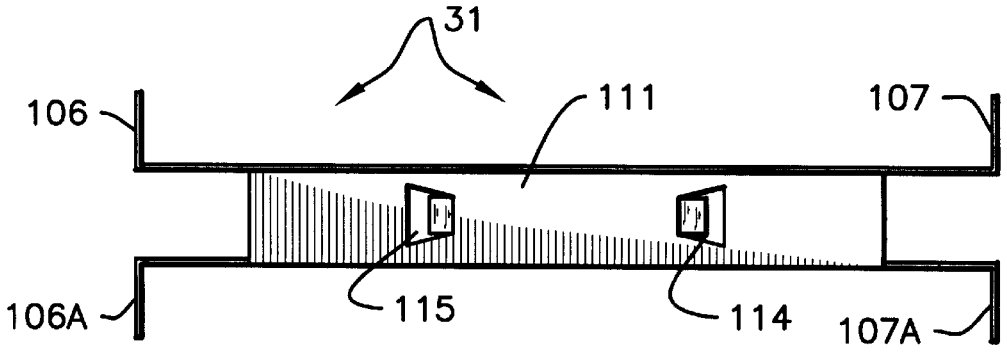
FIG. 10 is a top plan view of the rib of FIG. 8.

These notches are aimed upwardly beneath the enclosed volume bounded by the deployed target assembly when deployed for to mate with suitable portions of the reinforcement ribs 31 (FIGS. 8–10) that are fitted beneath the targets. The pieces mate as in FIG. 14.

Figure 12:
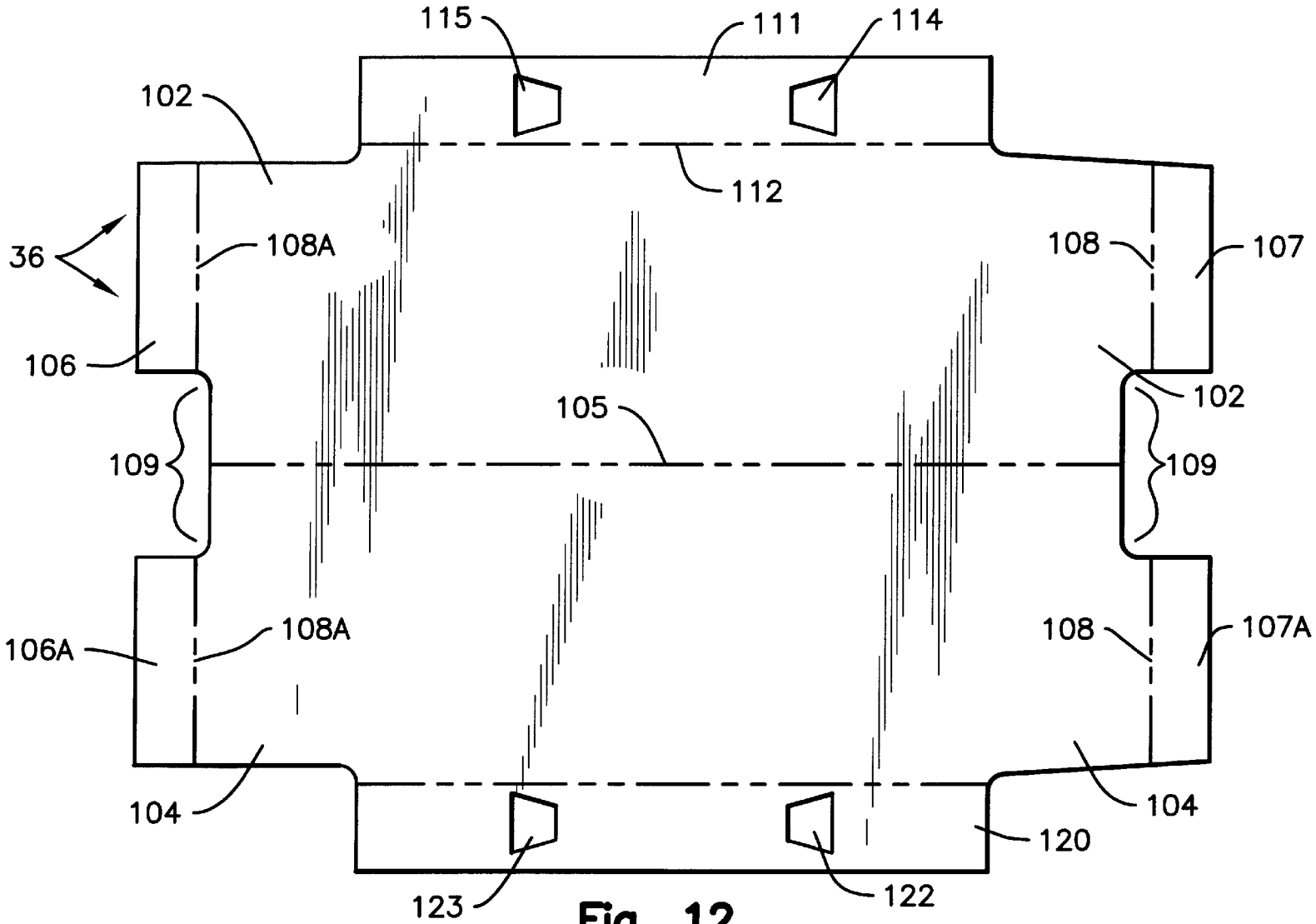
FIG. 12 is a plan view of the underside of the preferred, corrugated blank that is suitably folded to form reinforcement ribs.

Turning to FIGS. 5, 8–10 and 12, a preferred reinforcement rib 31 is formed by proper folding of corrugated blank 36 In the best mode, each target assembly is reinforced by a pair ribs, one larger than the other. These ribs contact the ground at the fold line on their bottoms, and their tops extend vertically upwardly to contact the underside of the playing impact surface. The reinforcing support added by the twin ribs increases the structural integrity of the target assemblies, and further minimizes bouncing effects when bags impact the playing surface. Each rib has a pair of integral, generally rectangular panels 102, 104 that border one another across fold line 105 (FIG. 12). During assembly, the panels 102, 104 are folded across the fold line 105, forming a V-shaped triangular configuration resulting in a fluteless, external "bottom" 125 (FIGS. 7, 13) that contacts ground. Bottom 125 results on the opposite side of fold line 105 depicted in FIG. 12.

Panels 102, 104 preferably have a pair of foldable end tabs 106, 107 or 106A, 107A separated therefrom by fold lines 108, 108A (FIG. 12). Tabs 106, 107 are respectively separated form tabs 106A, 107A by a suitable gap 109. Panel 102 is integral with a smaller subpanel 111, that borders it across fold line 112. A pair of foldable, trapezoidal punch-outs 114, 115 are precut into subpanel for deployment when the reinforcement rib if foldably deployed. The subpanel 120 foldably associated with panel 104 (FIG. 12) has a pair of trapezoidal orifices 122, 123 that register with deployed punch-outs 115, 114 during assembly. Subpanels 111, 120 overlie one another when assembled properly, being coupled to one another when punch-outs 115, 114 are first deflected and then manually pressed into engagement with orifices 123, 122. The subpanels form a strengthened, upper edge 124 (FIGS. 7, 13) of the rib that is pressed into contact with undersurface 29B (FIG. 11) when the rib is attached to the target assembly. At the same time, the lower supporting bottom 125 of each rib is fluteless, thereby avoiding the unwanted wicking of moisture into the rib by ground contact.

Figure 14:
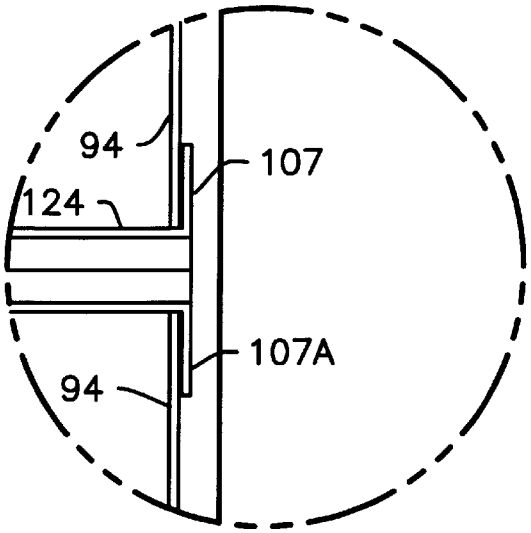
FIG. 14 is an enlarged, fragmentary elevational view of circled region 14 in FIG. 2.
Figures 7, 13:
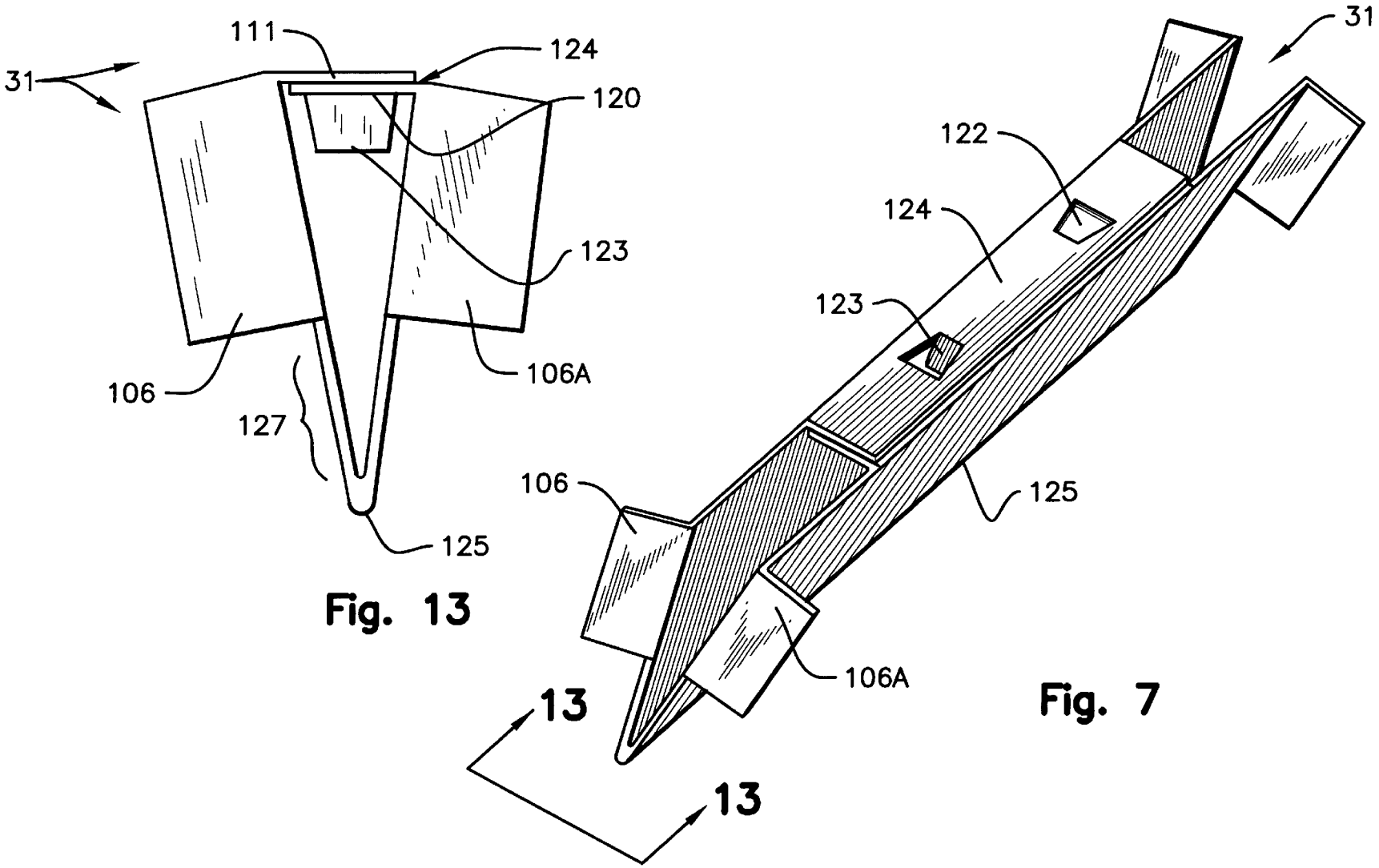
FIG. 7 is an isometric view of an assembled reinforcement rib.
FIG. 13 is an enlarged, elevational view taken generally from a position established by lines 13—13 in FIG. 7.

When the assembled ribs 31 are press fitted between the assembled sides 72, 73 of the target assembly, the V-shaped rib bottom (i.e. FIGS. 7, 13) resulting after folding has a clearance region 127 defined between tabs 106, 106A (or 107, 107A) and the bottom edge 125 (FIGS. 7, 13). Region 127 results after folding because of the gaps 109 (FIG. 12). In assembly the rib clearance region registers with notches 100, 101 cut in the side flaps 94 (FIG. 11) of the target assembly blank. Rib end tabs 106, 106A and/or 107, 107A effectively form a flange that is wedged between upwardly angling side flaps 94 and the target assembly undersurface 29B (FIGS. 11, 14). When pressed into position during assembly, opposite ends of each stiffener rib flatly contact the trapezoidal side panels 75. The ribs are thus captivated within the target assembly, with their fluteless, bottom edges projecting downwardly to help support the target assembly.

Assembly of the game is preceded by properly folding the target blank and the reinforcement rib blanks. Afterwards the ribs are attached by "snapping" them into place beneath the impact panel 28 within the enclosure defined by the target assembly. When the distance regulator is attached, the target assemblies can be placed apart on a flat playing surface at a preferred playing distance of twenty-five feet.

Target assembly folding is easiest if the blank 34 is first placed flat on a supporting surface with the underside aimed upwardly, as in FIG. 11. The front 46 and rear 49 can be assembled first, with the various panels being gently folded across the respective fold lines (52, 53 or 62, 63) with the locking tabs 61, 64 and/or 51, 54 being gently aimed at the matching slots 68, 69 or 58, 59. When the front 46 is folded, it is important that end flaps 80 be sandwiched between the front panels 55, 56 to brace the sides 72, 73. Then the locking tabs 51, 54 can be gently urged into engagement with the slots 58, 59. Similarly, the rear panels 65, 66 should properly sandwich flaps 90 before the locking tabs 61, 64 seat within slots 68, 69 (FIG. 11). Afterwards the sides are manipulated by gently folding the side panels 94 inwardly. Notches 100, 101 will thus be positioned to easily lock with the stiffener ribs to be installed thereafter.

The stiffener ribs 31 are quickly assembled by forcing them into a triangular profile by folding panels 102, 104 (FIG. 12) across fold line 105. Subpanels 111 and 120 should flatly contact one another and form the "base" of the "triangle." During assembly this base is forced upwardly into the target assembly into contact with the underside 29B of the central panel (FIG. 1). Punch-outs 114, 115 should be popped into position, properly frictionally engaging orifices 123, 122. Then end tabs 106, 106A and 107, 107A are gently folded out to form the wing-shaped, profile of FIGS. 7 and 10. The smaller stiffener is placed between notches 101, also extending between target assembly sides 72, 73. The larger stiffener rib is locked within notches 100 towards the larger rear 49 of the assembled target assembly.

With the target assemblies assembled, they are ready for deployment. The target assemblies are placed on the ground with the front of each assembly facing the other. Next, the distance regulator is attached, and target assemblies are moved apart until the regulator is fully extended. The distance regulator is preset for tournament play to a preferred playing distance of twenty feet.

Some players stand along side a target assembly with their feet firmly planted. Others may wish to stand directly behind their opponents target assembly, sacrificing distance for an angle reduction. Whatever the players stance, the opponent should always show proper respect for the players concentration by stepping back from the board until the player has completed his or her turn. A players toes must not project past the front edge of their opponent's target assembly.

Folding the bean bag 30 is a key element for scoring consistency. There are no secrets to bag folding, just personal preferences. The "Chicago Fold" has been a favorite of the top players. It is recommend that players hold the corner of a bag to let the particulate drop to the bottom; then the bag is folded in half, and then folded in half again. The "Paducah Pancake" is one of the most consistent fold among the underhand throwers. The bag is smoothed out and delivered flat or saucer like towards the hole. The "Half Paducah Pancake" is the same, only folded in half. The "Sacramento Sling" is accomplished by holding the bag by the corner or edge between two fingers prior to underhand tossing. An "Omaha overhead" delivery is usually the choice of basketball shooters with the bag wadded up in a ball.

A coin flip usually determines the side where a player chooses to stand. After a completed game, the losing player has the choice of sides. In team play, after a completed game the players are required to rotate boards to minimize the effect of wind and sun. The winning team shoot first or has "honors."

Basic scoring is flexible. Maximum points may be awarded for each bag 30 that penetrates orifice 32. Lesser points are earned by each bag that remains on the exposed playing surface 29A (FIG. 1) after a round.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein sit forth or shown in the accompanying drawings is to be interpreted as illustrative and not in a limiting sense.

What is claimed is:

1. A tossing game for use by one or more players, said game comprising:

a pair of generally wedge-shaped target assemblies adapted to be disposed upon a suitable supporting surface, each comprising an inclined impact surface towards which projectiles may be thrown, and a target aperture defined in said surface;

resilient ring means for reinforcing said target aperture, said resilient ring means comprising a plastic ring having a vertical lip for circumferentially contacting said target aperture and a horizontal flange portion for contacting said inclined surface;

a plurality of projectiles for tossing by said players at said target assemblies; and, wherein each of said target assemblies is foldably erected from a single blank of corrugated material.

2. The tossing game as defined in claim 1 further comprising rib means for reinforcing said target assemblies, the rib means folded together from a single blank of corrugated material.

3. The tossing game as defined in claim 1 wherein each target assembly blank comprises:

a central panel that forms the impact surface;

a dual panel front that is folded to form a fluteless bottom;

a dual panel rear that is folded to form a second fluteless bottom; and, a pair of folding sides that lock with the front and rear during assembly.

4. The tossing game as defined in claim 3 wherein each target assembly folding side further comprises a main panel, and an adjacent side flap that is adapted to be folded relative to said main panel to form a fluteless bottom at each side.

5. The tossing game as defined in claim 2 wherein said rib means blank comprises:

a pair of adjacent rectangular panels separated by a fold line and adapted to be folded, panels comprising a pair of spaced apart ends and an end tab at each end;

a subpanel foldably coupled to each of said rib means rectangular panels, the subpanels adapted to be form the bottom of the rib means when the rib means blank is appropriately folded into a configuration with a triangular cross section.

6. The tossing game as defined in claim 5 wherein each target assembly blank comprises:

a central panel that forms the impact surface;

a front with a fluteless bottom;

a rear with a fluteless bottom; and, a pair of folding sides with fluteless bottoms.

7. The tossing game as defined in claim 6 wherein each target assembly side further comprises a central panel and adjacent side flaps foldably coupled to the central panel, the side flaps comprising spaced apart notches.

8. The tossing game as defined in claim 7 wherein said rib means end tabs are adapted to be folded apart to form a flange that locks against said spaced apart notches in said side flaps when the rib means is attached to said target assemblies.

9. A corrugated blank adapted to be folded into an wedge shaped target assembly for a tossing game, the blank comprising:

a generally rectangular, central panel that forms an inclined playing surface of the target assembly, the panel having a target aperture;

an integral front comprising a pair of foldable panels adapted to be folded over each other to form a fluteless bottom, one of said last mentioned panels comprising outwardly projecting locking tabs;

slot means for receiving the front's locking tabs;

an integral rear comprising a pair of foldable panels adapted to be folded over each other to form a fluteless bottom, one of said last mentioned panels comprising outwardly projecting locking tabs;

additional slot means for receiving the rear's locking tabs;

a pair of foldable sides comprising trapezoidal panels foldably coupled to said central panel, side flaps adapted to be folded over the trapezoidal panel to form a fluteless bottom, and end flaps adapted to be captivated by the front and rear when they are assembled.

10. The blank as defined in claim 9, further comprising another unitary blank that may be folded into a rib for reinforcing said target assembly, said last mentioned blank comprising:

a pair of integral, generally rectangular panels that border one another along a fold line, said last-mentioned rectangular panels foldable into a V-shaped configuration;

each of said last mentioned panels comprising a pair of foldable end tabs separated therefrom by fold lines;

a space gap between said end tabs;

a smaller subpanel bordering each said last mentioned generally rectangular panels across another fold line, wherein the subpanels form the bottom of a triangle when the last mentioned rectangular panels are folded into a V-shaped configuration.

11. The blank as defined in claim 9 further comprising resilient ring means for reinforcing said target aperture.

12. The blank as defined in claim 11 wherein said resilient ring means comprises a plastic ring having a vertical lip for circumferentially contacting said aperture and a horizontal flange portion for contacting the central panel.

13. A tossing game for use by one or more players, said game comprising:

a pair of generally wedge-shaped target assemblies adapted to be disposed upon a suitable supporting surface, each target assembly comprising an inclined impact surface towards which projectiles may be thrown, and a target aperture defined in said surface;

a plurality of projectiles for tossing by said players at said target assemblies; and, wherein each of said target assemblies is folded together from a single blank of corrugated material, said blank comprising:

a central panel that forms the impact surface;

a dual panel front that is folded to form a fluteless bottom;

a dual panel rear that is folded to form a fluteless bottom; and, a pair of folding sides comprising a main panel, an adjacent side flap that is folded to form a fluteless bottom and that comprises spaced-apart notches, and a pair of end flaps that lock with the front and rear during assembly.

14. The tossing game as defined in claim 13 further comprising rib means for reinforcing said target assemblies, the rib means folded together from a single blank of corrugated material, said rib means blank comprising:

a pair of adjacent rectangular panels separated by a fold line and adapted to be folded into a V-shaped configuration, each last mentioned panel having an end tab at each end;

a subpanel foldably coupled to each of said rib means panels, the subpanels adapted to be form the bottom of a triangle with the rib means blank is appropriately folded; and, punch-out means in said subpanels for fastening them together.

15. The tossing game as defined in claim 14 wherein said rib means rectangular panels each comprise end tabs adapted to be folded apart to form a flange that locks against said spaced apart notches when the rib means is attached to said target assemblies.

16. The tossing game as defined in claim 14 further comprising resilient ring means for reinforcing said target aperture, said resilient ring means comprising a plastic ring having a vertical lip for circumferentially contacting said inclined surface and a horizontal flange portion for contacting said inclined surface.

17. A tossing game for use by one or more players, said game comprising:

a pair of generally wedge-shaped target assemblies adapted to be disposed upon a suitable supporting surface, each target assembly comprising an inclined impact surface towards which projectiles may be thrown, and a target aperture defined in said impact surface;

a plurality of projectiles for tossing by said players at said target assemblies; and, wherein each of said target assemblies is foldably erected from a single blank of corrugated material, each target assembly blank comprising:

a central panel that forms the impact surface;

a dual panel front that is folded to form a fluteless bottom;

a dual panel rear that is folded to form a second fluteless bottom; and, a pair of folding sides that lock with the front and rear during assembly.

18. The tossing game as defined in claim 17 wherein each target assembly folding side further comprises a central panel, and an adjacent side flap that is adapted to be folded relative to said side central panel to provide each side with a fluteless bottom.

19. The tossing game as defined in claim 17 further comprising:

means for regulating the distance between said target assemblies;

rib means for reinforcing said target assemblies, the rib means folded together from a single blank of corrugated material; and, resilient ring means for reinforcing said target aperture.

20. The tossing game as defined in claim 17 further comprising rib means for reinforcing said target assemblies, the rib means folded together from a single blank of corrugated material.

21. The tossing game as defined in claim 20 wherein said rib means blank comprises:

a pair of adjacent rectangular panels separated by a fold line, each panel comprising a pair of ends and end tabs disposed at each end;

a subpanel foldably coupled to each of said rib means rectangular panels, the subpanels adapted to form the bottom of the rib means when the rib means blank is appropriately folded.

22. The tossing game as defined in claim 20 wherein each target assembly side further comprises a central panel and adjacent side flaps foldably coupled to the central panel, the side flaps comprising spaced apart notches, and wherein said rib means comprises end tabs adapted to be folded apart to form a flange that locks against said notches in said side flaps when the rib means is attached to said target assemblies.

* * * * *